United States Patent [19]

Nordeen

[11] 4,426,751

[45] Jan. 24, 1984

[54] VACUUM CLEANER NOZZLE WITH DOUBLE BRUSH

[75] Inventor: Erwin E. Nordeen, St. Paul, Minn.

[73] Assignee: Whirlpool Corporation, Benton Harbor, Mich.

[21] Appl. No.: 341,581

[22] Filed: Jan. 21, 1982

[51] Int. Cl.[3] ..... A47L 5/30

[52] U.S. Cl. ..... 15/384

[58] Field of Search ..... 15/384, 390

[56] References Cited

U.S. PATENT DOCUMENTS

| | | | |
|---|---|---|---|
| 1,268,963 | 6/1918 | Gray | 15/384 X |
| 1,417,768 | 5/1922 | Radimak | 15/384 X |
| 1,891,504 | 12/1932 | Smellie . | |
| 2,102,645 | 12/1937 | Replogle . | |
| 2,210,950 | 8/1940 | Replogle . | |
| 2,651,803 | 9/1953 | Browne | 15/373 |
| 3,220,043 | 11/1965 | Lampe | 15/340 |
| 3,624,861 | 12/1971 | Freheit | 15/320 |
| 4,267,617 | 5/1981 | Brown et al. | 15/384 X |

FOREIGN PATENT DOCUMENTS

| | | | |
|---|---|---|---|
| 503630 | 7/1930 | Fed. Rep. of Germany | 15/384 |
| 695840 | 9/1965 | Italy | 15/384 |

*Primary Examiner*—Chris K. Moore

*Attorney, Agent, or Firm*—Wood, Dalton, Phillips, Mason & Rowe

[57] ABSTRACT

A vacuum cleaner nozzle having a front suction inlet and a suction passage. A first brush is rotatably mounted to the nozzle at the suction inlet, and a second brush is rotatably mounted to the nozzle adjacent the first brush at the suction inlet. A first transfer passage extends from the suction inlet adjacent the first brush for passing material dislodged by the first brush to the suction passage. A second transfer passage extends from the suction inlet adjacent the second brush for transferring material from the second brush to the second transfer passage. In one form, the brushes are rotated by separate drive means, and in another form, one of the brushes is rotated by drive means and is coupled to the other brush for rotation thereof. The brushes, in the illustrated embodiment, rotate in opposite directions so that a brush is brushing forwardly relative to the movement of the vacuum cleaner and either of opposite directions of movement thereof. The transfer passages are arranged to open generally tangentially to the brushes for improved transfer of material thereinto. Portions of the walls of the structure are disposed to strip from the brushes material clinging to the periphery thereof at the entrance to the transfer passages.

23 Claims, 5 Drawing Figures

FIG. 4
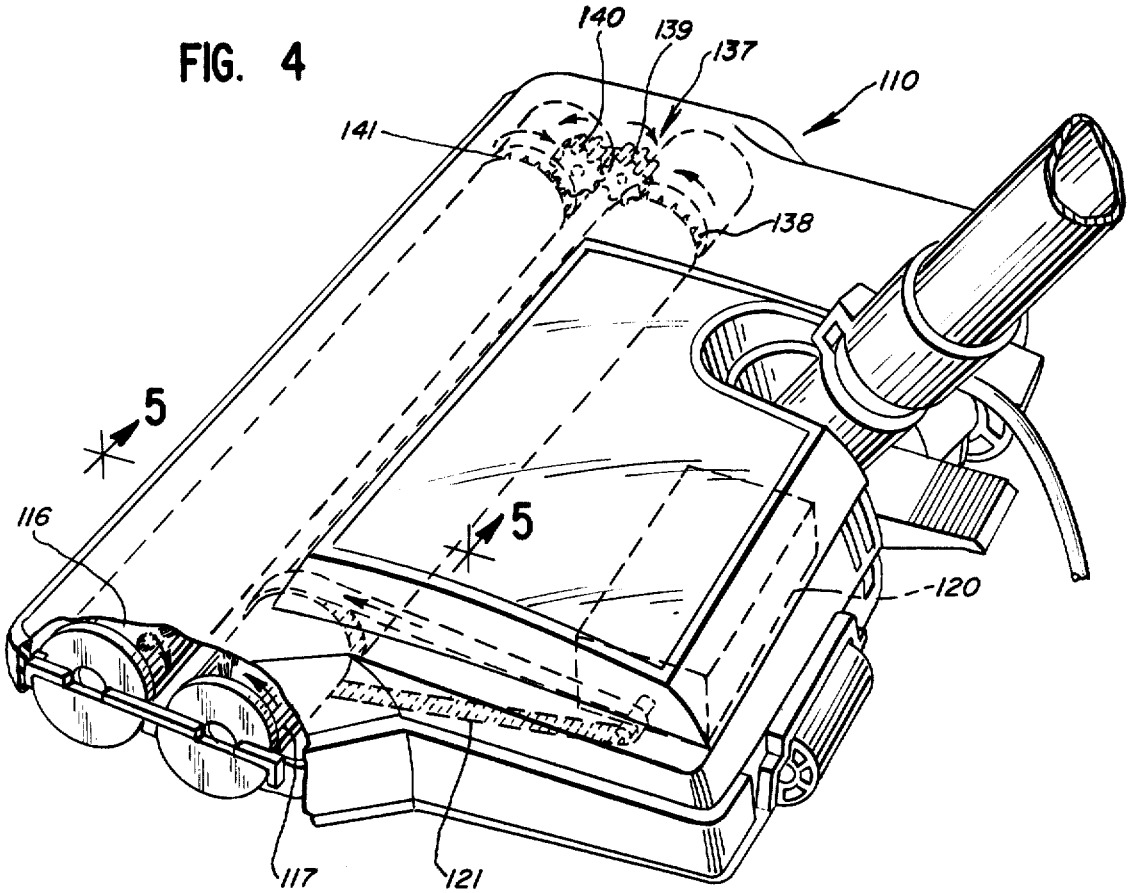
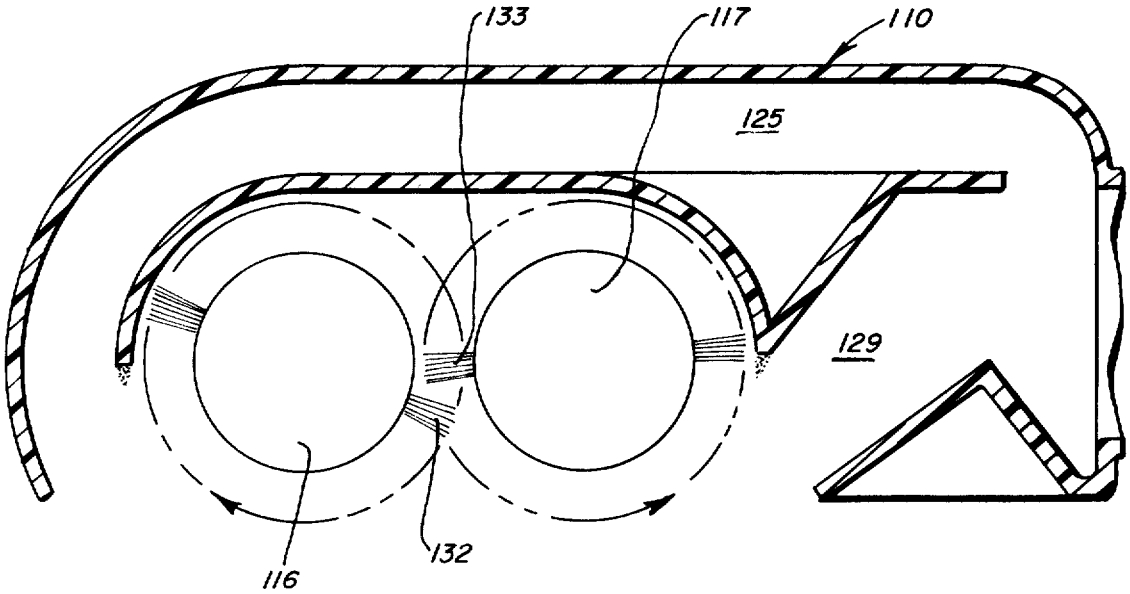
FIG. 5

VACUUM CLEANER NOZZLE WITH DOUBLE BRUSH

BACKGROUND OF THE INVENTION

1. Field of the Invention

This invention relates to vacuum cleaners and in particular to brush means for use in vaccum cleaner nozzles.

2. Description of the Background Art

In U.S. Pat. No. 1,891,504, Donald G. Smellie discloses a suction cleaner having recessed beaters comprising parallel, rotary, agitators. The beaters are provided with helical grooves and are provided at the midportion thereof with gears driven by a pair of worms on a drive shaft both driven by an electric motor.

D. B. Replogle, in U.S. Pat. No. 2,102,645, shows a double brush type floor tool wherein the brushes are independently driven by a pair of motors, one running in one direction and the other in the opposite direction. The brushes are disposed in a single large chamber at the front of the nozzle.

D. B. Replogle also discloses, in U.S. Pat. No. 2,210,950, a suction cleaner wherein a pair of rotatable agitators, comprising a brush and a beater, are rotated in opposite directions within a single large chamber by belts driven from a motor shaft extending in opposite directions therefrom to the respective brushes.

James Brown discloses, in U.S. Pat. No. 2,651,803, a multiple brush carpet sweeper wherein the brushes are mounted in a large cavity at the front of the nozzle.

A double brush rug scrubber is illustrated in U.S. Pat. No. 3,624,861 of Frederick E. Freiheit. The brushes, as disclosed therein, are received in a single large housing and are utilized for scrubbing purposes.

SUMMARY OF THE INVENTION

The present invention comprehends an improved brush system for use in a vacuum cleaner having a wheeled nozzle defining a front suction inlet and a suction passage with means for providing suction to the suction passage. The brush structure includes a first brush rotatably mounted to the nozzle at the suction inlet, wall means on the nozzle defining a first transfer passage extending from the suction inlet adjacent the first brush to the suction passage, a second brush rotatably mounted to the nozzle at the suction inlet, wall means on the nozzle defining a second transfer passage extending from the suction inlet adjacent the second brush to the suction passage, means for rotating the first brush to sweep brushed material into the first transfer passage, and means for rotating the second brush to sweep brushed material into the second transfer passage.

In the illustrated embodiment, the means for rotating the brushes comprises means for rotating the brushes in opposite directions of rotation.

In one form, a first drive is provided for rotating one of the brushes and a second drive is provided for rotating the other. In another form, a single drive is utilized driving one of the brushes, with that brush being drivingly connected to the other brush for effecting concurrent reverse rotation of the two brushes.

In the illustrated embodiment, the wall means are formed integrally with the top and bottom wall of the nozzle.

The first transfer passage extends from the suction inlet forwardly adjacent the first brush to the suction passage, and the second transfer passage extends from the suction inlet rearwardly adjacent the second brush to the suction passage.

In the illustrated embodiment, the transfer passages open generally tangentially to the associated brushes so that brushed material may be swept substantially directly into the transfer passages by the rotating brushes for improved transfer to the suction passage.

The wall means defining the first passage, in the illustrated embodiment, includes a top wall portion of the nozzle and a wall spaced inwardly from the top wall portion.

The wall means defining the second passage, in the illustrated embodiment, includes a bottom wall portion of the nozzle and a wall portion extending angularly upwardly therefrom.

In the illustrated embodiment, the width of the transfer passages is substantially the length of the brushes.

In the illustrated embodiment, the first transfer passage extends, in part, above the brushes to rearwardly of the second brush.

The transfer passages, in the illustrated embodiment, open rearwardly to the suction inlet, with one of the transfer passages opening downwardly to the suction passage and the other opening upwardly thereto, whereby the transfer passages are effectively directed in somewhat of a counterflow relationship at the entrance to the suction passage.

The invention further comprehends the provision of means for stripping from the brushes material clinging to the periphery thereof at the entrance to the respective transfer passages.

In the illustrated embodiment, the stripping means comprises an edge of the wall means projecting oppositely to the direction of rotation of the associated brush.

In the illustrated embodiment, the stripping wall edge means are disposed substantially at the level of the axis of rotation of the brushes.

The improved vacuum cleaner brush structure of the present invention is extremely simple and economical of construction while yet providing a highly improved brushing action and facilitated control of movement of the vacuum cleaner on the wheeled nozzle thereof.

BRIEF DESCRIPTION OF THE DRAWING

Other features and advantages of the invention will be apparent from the following description taken in connection with the accompanying drawing wherein:

FIG. 4 is a fragmentary perspective view of a vacuum cleaner having a modified form of brush structure embodying the invention; and FIG. 5 is a fragmentary enlarged vertical section taken substantially along the line 5—5 of FIG. 4.

DESCRIPTION OF THE PREFERRED EMBODIMENTS

Figure 1:
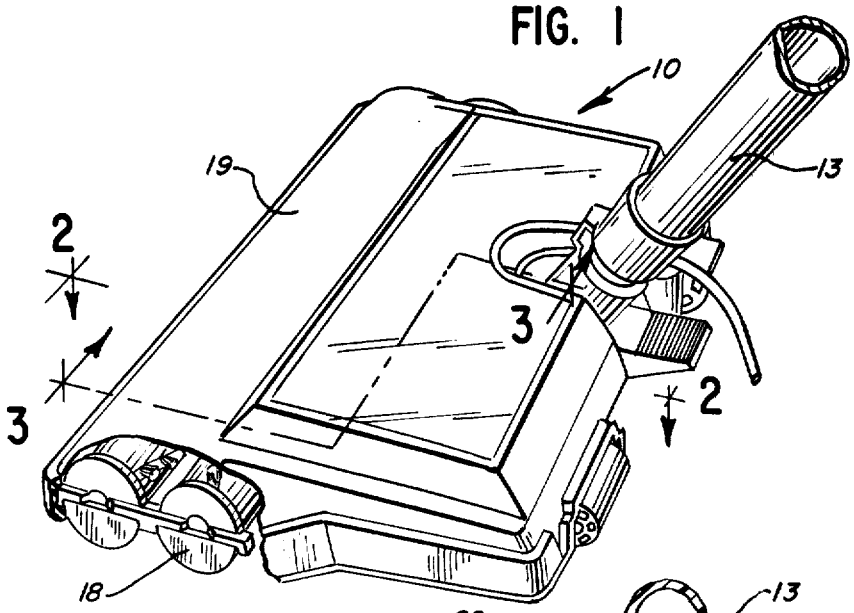
FIG. 1 is a fragmentary perspective view of a portion of a vacuum cleaner having a pair of brushes and related structure embodying the invention, with portions broken away to illustrate a portion of the brush structure.
Figure 2:
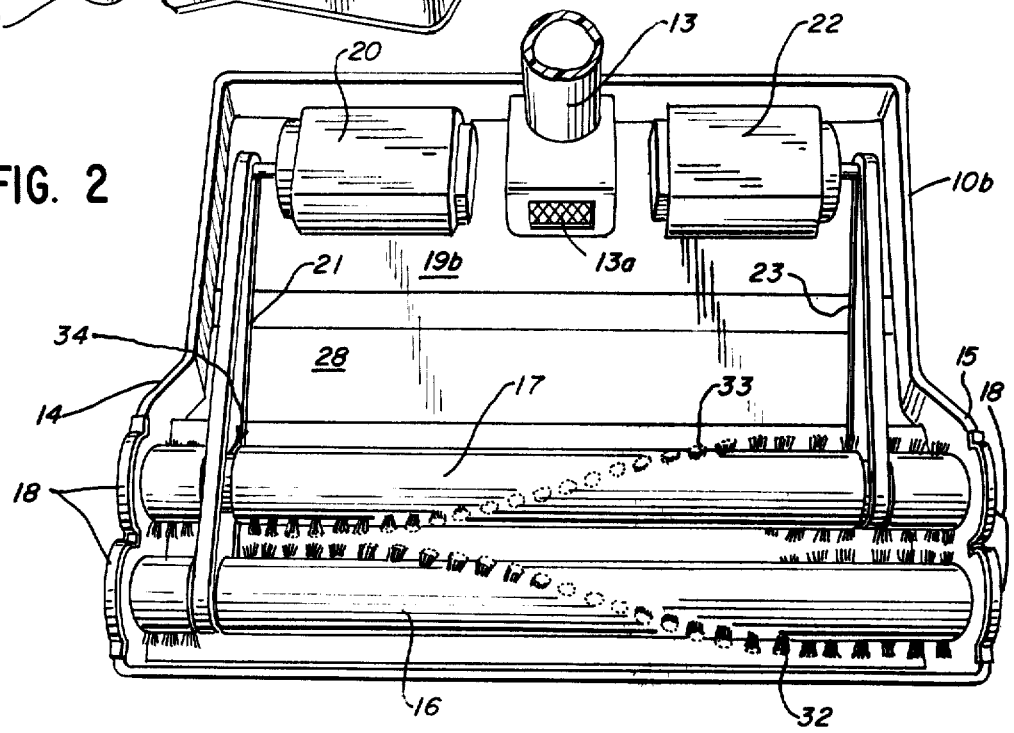
FIG. 2 is a horizontal section taken substantially along the line 2—2 of FIG. 1 with the top wall of the nozzle and its associated transfer passage wall removed to illustrate the underlying structure.
Figure 3:
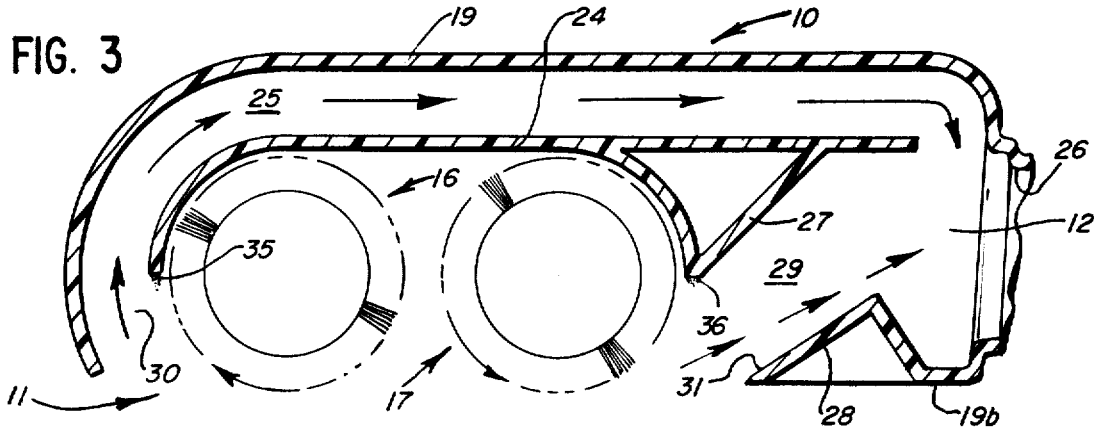
FIG. 3 is a fragmentary enlarged vertical section taken substantially along the line 3—3 of FIG. 1.

In the illustrative embodiment of the invention as disclosed in FIGS. 1-3 of the drawing, a vacuum cleaner nozzle generally designated 10 comprises a wheeled nozzle having a front suction inlet generally designated 11 and a suction passage generally designated 12 formed in a rear portion thereof which is connected to a source of suction (not shown), as through a tubular handle 13 having a dirt laden air opening 13*a* in its base which is aligned with and connected to passage 12. The nozzle top wall is generally designated 19 and its bottom wall is generally designated 19*b*.

The nozzle bottom wall defines upwardly extending sidewalls 14 and 15. A pair of brushes 16 and 17 are rotatably carried in suitable end bearings 18 carried by the sidewalls 14 and 15 for disposing the brushes rotatably at the suction inlet 11. As shown in FIGS. 1 and 3, the nozzle 10 further defines a top wall 19 which overlies the brushes and suction inlet.

As shown in FIG. 2, brushes 16 and 17 are mounted for rotation in adjacent parallel relationship. Front brush 16 is rotated by a first drive motor 20 and a belt drive 21. Brush 17 is rotated by a second drive motor 22 and a belt drive 23.

As seen in FIG. 3, nozzle 10 is further provided with a transverse wall 24 which cooperates with the top wall 19 thereof in defining a first transfer passage 25 leading from suction inlet 11 adjacent brush 16 to the entrance 26 to the suction passage 12. Entrance 26 is aligned with air opening 13*a* and is of substantially the same size and shape. A second pair of walls 27 and 28 are formed integrally with the top and bottom walls of the nozzle rearwardly of brush 17 to define a second transfer passage 29 extending from the suction inlet 11 to the entrance 26 of the suction passage 12.

As shown in FIG. 3, first transfer passage 25 opens downwardly to the suction passage entrance 26 and suction passage 29 opens upwardly thereto.

As further shown in FIG. 3, the entrance 30 to the first suction passage 25 opens generally tangentially to brush 16 and the entrance 31 to transfer passage 29 opens generally tangentially to brush 17. Thus, material picked up by the brushes is swept substantially directly into the transfer passage entrances 30 and 31 by the brushes in the operation of the vacuum cleaner.

As shown in FIG. 2, the brushes are provided with helical rows of bristles 32 and 33, respectively, extending substantially the full length of the brushes.

In the illustrated embodiment of FIG. 2 the helical row of bristles 32 of brush 16, closest to the front of the nozzle 10, has a right hand twist, while the helical row of bristles 33 of brush 17 closest to the rear of nozzle 10 has an opposed, left hand twist when the helical rows are viewed from the left side of the nozzle. Conversely, the front helical row 32 may have a left hand twist while the rear helical row 33 may have an opposed right hand twist. In other words, in the preferred embodiment the helical rows of bristles 32 and 33 for the front and rear brushes twist in opposite directions. This arrangement has been found to balance or neutralize twisting forces which may be imparted to the nozzle by the rotating brushes during operation of the cleaner and is considered an essential arrangement for ease in moving the nozzle in a straight path during cleaning.

While the illustrated brushes 16 and 17 extend the full length of the respective agitator dowels it will be recognized that, if desired, appropriately placed beater bar sections could be substituted for portions of the respective brushes.

The transfer passages 25 and 29 and inlets thereto extend substantially the full length of the brushes for improved pickup and transfer of material from the brushes to the suction passage 12 in the operation of the vacuum cleaner.

In the illustrated embodiment, brush 17 defines an annular groove 34 for passing the belt 21 to brush 16, as best seen in FIG. 2.

As further shown in FIG. 3, wall 24 defines a leading edge 35 which acts as a stripper for stripping from the brushes material clinging to the periphery thereof at the entrance 30 to the transfer passage 25. Similarly, wall 27 defines an edge 36 for stripping from the brush 17 material clinging to the periphery thereof at the entrance 31 to the transfer passage 29. As shown, the edges 35 and 36 are disposed closely adjacent the respective brushes for improved stripping operation.

In operation, the brushes 16 and 17 sweep material directly into the entrances 30 and 31 of the respective transfer passages 25 and 29 in a highly efficient manner. As can be seen from FIG. 3, the entrances 30 and 31 are large, having a height substantially equal to the radius of the brushes so that the stripping edges 35 and 36 are closely juxtaposed to the peripheries of the respective brushes substantially at the level of the axis of rotation of the brushes.

As the brushes are rotated in opposite directions, one of the brushes is rotating in the direction of the movement of the wheeled nozzle in whichever direction the nozzle is being moved as it is moving back and forth over a surface being cleaned. Thus, where the vacuum cleaner is being operated on a carpet, one of the brushes is brushing the nap of the carpet toward the associated transfer passage entrance while the other brush is acting against the nap of the carpet to urge the nozzle in the desired direction of movement. In addition, the last named brush also serves to deliver brushed material from the carpet into its associated transfer passage entrance.

The embodiment of the invention disclosed in FIGS. 1-3 had demonstrated a greatly improved soil pick-up performance, specifically, an approximate 87% improvement, over the performance of a comparable conventional single brush vacuum cleaner unit as follows:

| Unit Tested | Grams of Soil Pick-Up | Percent of Total Soil* |
|---|---|---|
| Double Brush Embodiment of FIGS. 1-3 | 32.0 | 39.5 |
| Comparable Single Brush Conventional Unit | 17.08 | 21.1 |

*Total Soil consisted of 73 grams of sand plus 8 grams of talc, total 81 grams.

The units were tested using an adaptation of ASTM method F608-79 (former proposed procedure F11.21). The test carpet was an Acrylan cut plush with a level pile.

Referring now to the embodiment of FIGS. 4 and 5, a modified form of vacuum cleaner nozzle generally designated 110 is shown to comprise a nozzle similar to nozzle 10 but having a single drive motor 120 and a single belt drive 121 rotatively driving the rear brush 117. Front brush 116 is driven from rear brush 117 by a gear system generally designated 137, including a driver gear 138 on brush 117, a first transfer gear 139 meshing with driver gear 138, and a second transfer gear 140 meshing with transfer gear 139. Second transfer gear 140, in turn, meshes with a gear 141 on brush 116 whereby the brush 116 is driven in an opposite direction of rotation from the rotation of brush 117, but in accurate synchronization therewith.

As the brushes are driven in synchronization, the rows of bristles 132 of front brush 116 may be interfitted with the rows of bristles 133 of the rear brush 117 without interference therebetween. Thus, as seen in FIG. 5, the brushes may be more closely juxtaposed to provide a more compact brush arrangement at the front of the vacuum cleaner nozzle. By suitably arranging the helical configuration, the brushes may provide improved brushing action in the operation of the vacuum cleaner.

Other than described specifically above, vacuum cleaner structure 110 is similar to vacuum cleaner structure 10 and similar elements thereof are identified by similar reference numerals but 100 higher.

The foregoing disclosure of specific embodiments is illustrated of the broad inventive concepts comprehended by the invention.

I claim:

1. In a vacuum cleaner having a wheeled nozzle defining a front suction inlet, and a suction passage, and means for providing a suction to said passage, the improvement comprising:

a first brush rotatably mounted to said nozzle at said suction inlet;

wall means on said nozzle defining a first transfer passage extending from said suction inlet adjacent said first brush to said suction passage;

a second brush rotatably mounted to said nozzle immediately adjacent to and unobstructedly confronting said first brush at said suction inlet;

wall means on said nozzle defining a second transfer passage extending from said suction inlet adjacent said second brush to said suction passage;

means for rotating said first brush to sweep material from said suction inlet and brushed material from said second brush into said first transfer passage; and means for rotating said second brush to sweep material from said suction inlet and brushed material from said first brush into said second transfer passage.

2. The vacuum cleaner structure of claim 1 wherein said means for rotating the brushes comprise means for rotating the brushes in opposite directions of rotation.

3. The vacuum cleaner structure of claim 1 wherein said means for rotating the brushes comprise first drive means for rotating said first brush and second drive means for rotating said second brush.

4. The vacuum cleaner structure of claim 1 wherein said means for rotating the brushes comprise first belt drive means for rotating said first brush and second belt drive means for rotating said second brush.

5. The vacuum cleaner structure of claim 1 wherein said means for rotating the brushes comprise motor-operated drive means for rotating said first brush and second motor-operated drive means for rotating said second brush.

6. The vacuum cleaner structure of claim 1 wherein said means for rotating the brushes comprises means for rotating one of said brushes, and means for interconnecting said brushes for rotating the other of said brushes as an incident of the rotation of the first brush.

7. The vacuum cleaner structure of claim 1 wherein said wall means are formed integrally with said nozzle.

8. The vacuum cleaner structure of claim 1 wherein one of said brushes is always moving in the same direction as said nozzle is moving as it is moved back and forth over a surface being cleaned.

9. In a vacuum cleaner having a wheeled nozzle defining a front suction inlet, and a suction passage, and means for providing a suction to said passage, the improvement comprising:

a first brush rotatably mounted to said nozzle at said suction inlet;

wall means on said nozzle defining a first transfer passage extending from said suction inlet adjacent said first brush to said suction passage;

a second brush rotatably mounted to said nozzle at said suction inlet;

wall means on said nozzle defining a second transfer passage extending from said suction inlet adjacent said second brush to said suction passage;

means for rotating said first brush to sweep brushed material into said first transfer passage; and means for rotating said second brush to sweep brushed material into said second transfer passage, said first brush comprising a helical row of bristles having a twist in a first direction, and said second brush comprising a helical row of bristles having a twist in a second direction opposite said first direction.

10. In a vacuum cleaner having a wheeled nozzle defining a front suction inlet, and a suction passage, and means for providing a suction to said passage, the improvement comprising:

a front brush rotatably mounted to said nozzle at said suction inlet;

wall means on said nozzle defining a first transfer passage extending from said suction inlet forwardly adjacent said front brush to said suction passage;

a rear brush rotatably mounted to said nozzle at said suction inlet;

wall means on said nozzle defining a second transfer passage extending from said suction inlet rearwardly adjacent said rear brush to said suction passage;

means for rotating said front brush to sweep brushed material forwardly upwardly into said first transfer passage; and means for rotating said rear brush to sweep brushed material rearwardly upwardly into said second transfer passage, each of said transfer passages opening generally tangentially to its associated brushes whereby the brushed material is swept substantially directly into the transfer passage by the rotating brush.

11. The vacuum cleaner structure of claim 10 wherein said wall means defining said first passage includes an outer portion of the nozzle and a wall spaced inwardly from said outer portion.

12. The vacuum cleaner structure of claim 10 wherein said first transfer passage extends transversely substantially the length of the front brush.

13. The vacuum cleaner structure of claim 10 wherein said second transfer passage extends transversely substantially the length of the rear brush.

14. The vacuum cleaner structure of claim 10 wherein said first transfer passage extends in part above said brushes.

15. The vacuum cleaner structure of claim 10 wherein said first transfer passage extends in part above said brushes and opens downwardly to said suction passage.

16. The vacuum cleaner structure of claim 10 wherein said second transfer passage opens upwardly to said suction passage.

17. The vacuum cleaner structure of claim 10 wherein said transfer passages are directed in counterflow relationship at the entrance to said suction passage.

18. In a vacuum cleaner having a wheeled nozzle defining a front suction inlet, and a suction passage, and means for providing a suction to said passage, the improvement comprising:

a first brush rotatably mounted to said nozzle at said suction inlet;

wall means on said nozzle defining a first transfer passage extending from said suction inlet adjacent said first brush to said suction passage;

a second brush rotatably mounted to said nozzle at said suction inlet;

wall means on said nozzle defining a second transfer passage extending from said suction inlet adjacent said second brush to said suction passage;

means for rotating said first brush to sweep brushed material into said first transfer passage;

means for rotating said second brush to sweep brushed material into said second transfer passage; and means for stripping from the brushes material clinging to the periphery thereof at the entrance to the respective transfer passages, said entrance to the transfer passages being open downwardly from the stripping means to said suction inlet.

19. The vacuum cleaner structure of claim 18 wherein said means for stripping comprises an edge of the wall means projecting oppositely to the direction of rotation of the associated brush and closely juxtaposed to the periphery of the brush.

20. In a vacuum cleaner having a wheeled nozzle defining a front suction inlet, and a suction passage, and means for providing a suction to said passage, the improvement comprising:

a first brush rotatably mounted to said nozzle at said suction inlet;

wall means on said nozzle defining a first transfer passage extending from said suction inlet adjacent said first brush to said suction passage;

a second brush rotatably mounted to said nozzle at said suction inlet;

wall means on said nozzle defining a second transfer passage extending from said suction inlet adjacent said second brush to said suction passage;

means for rotating said first brush to sweep brushed material into said first transfer passage;

means for rotating said second brush to sweep brushed material into said second transfer passage; and means for stripping from the brushes material clinging to the periphery thereof at the entrance to the respective transfer passages, the opening to each of said transfer passages having a height adjacent the associated brush of approximately the radius of the brush and each said edge being disposed substantially at the level of the axis of rotation of the brush.

21. In a vacuum cleaner having a wheeled nozzle defining a front suction inlet, and a suction passage, and means for providing a suction to said passage, the improvement comprising:

a first brush rotatably mounted to said nozzle at said suction inlet and having at least one row of bristles;

wall means on said nozzle defining a first transfer passage extending from said suction inlet adjacent said first brush to said suction passage;

a second brush rotatably mounted to said nozzle at said suction inlet and having at least one row of bristles, the rows of bristles of the first brush being interfitted between the rows of bristles of the second brush;

wall means on said nozzle defining a second transfer passage extending from said suction inlet adjacent said second brush to said suction passage; and means for rotating said brushes in synchronization to sweep brushed material into said transfer passages.

22. The vacuum cleaner structure of claim 21 wherein said rotating means include gear means interconnecting said brushes for causing the brushes to rotate in synchronization in opposite directions of rotation.

23. The vacuum cleaner structure of claim 21 wherein the rows of bristles extend helically.

* * * * *